United States Patent [19]

Ramcke et al.

[11] 4,297,066

[45] Oct. 27, 1981

[54] PAPER SHEET LAYER FORMING AND TRANSFERRING ARRANGEMENT

[75] Inventors: Bernd Ramcke, Hamburg; Karl-Heinz Schlottke, Tangstedt; Eckhard Brandt; Klaus Reissmann, both of Hamburg, all of Fed. Rep. of Germany

[73] Assignee: E. C. H. Will (GmbH & Co.), Hamburg, Fed. Rep. of Germany

[21] Appl. No.: 65,874

[22] Filed: Aug. 13, 1979

[30] Foreign Application Priority Data

Aug. 12, 1978 [DE] Fed. Rep. of Germany ..... 2835416

[51] Int. Cl.[3] ..... B65H 31/30; B65H 31/32

[52] U.S. Cl. ..... 414/43; 198/422; 271/85; 271/218; 414/115; 414/901; 414/907

[58] Field of Search ..... 414/43, 115, 901, 907; 271/85, 218; 93/93 DP; 198/422

[56] References Cited

U.S. PATENT DOCUMENTS 3,867,876 2/1975 Van de Gent ..... 93/93 DP
4,043,458 8/1977 Schott ..... 271/218 X

FOREIGN PATENT DOCUMENTS 2508745 9/1976 Fed. Rep. of Germany ..... 414/43

*Primary Examiner*—Leslie J. Paperner

*Attorney, Agent, or Firm*—Peter K. Kontler

[57] ABSTRACT

An arrangement for forming successive layers of sheets of paper and the like from a stream of individual sheets supplied in succession to a collecting station by a supply conveyor, and for transferring the formed layers to a continuously advancing discharge conveyor, includes an abutment capable of interrupting the advancement of the supplied sheets to form a layer from a predetermined number of sheets, and a clamping device which grips the layer of sheets and transfers the same to the discharge conveyor. The arrangement includes a drive including a transmission, particularly a kinematic linkage transmission, causing the abutment and clamping device to perform a preselected succession of movements, and a prime mover which is kinematically separated from the main drive of the machine in which the arrangement is used and thus from the drive of the supply and discharge conveyors. The speed, acceleration and deceleration of the separate motor are controlled by a control arrangement which ascertains the delivery of a preselected number of sheets to the collecting station and thus the formation of a layer containing the predetermined number of sheets and causes the arrangement to perform its operating cycle while the formation of the next-following layer takes place at the collecting station.

8 Claims, 8 Drawing Figures

S
2a
2b
3a
45a
0
360°

V
47a
0
360°

82
7
83
88
91
87
51
89
49
97
96
98
93
92
99
86
26
94
100
24
95

PAPER SHEET LAYER FORMING AND TRANSFERRING ARRANGEMENT

BACKGROUND OF THE INVENTION

The present invention relates to an arrangement for forming layers from individual sheets and for transporting the formed layers in general, and more particularly to an arrangement for forming successive layers of sheets of paper and the like from a stream of individual sheets supplied in succession to a collecting location by a supplying conveyor, and for transferring the formed layers to a continuously advancing discharge conveyor.

Arrangements of this general type are already known and in widespread use. Usually, an arrangement of this type includes an abutment which is movable into and out of the trajectory or the sheets at the collecting location, a clamping device including positionally controllable jaws which is movable between the collecting location and the discharge conveyor, and a mechanical transmission by means of which the abutment and the clamping device are kinematically connected with one another as well as with a common drive.

An arrangement of this type is usually the last structural unit of a machine which operates in a predetermined cycle, to which there is connected another machine which may also operate in the predetermined machine cycle or may treat layers of sheets supplied thereto in an arbitrary rhythm. The operating cycle of the first mentioned machine is determined by the succession of cuts performed by a transverse cutter which cuts either a single paper web withdrawn from a single supply roll or a plurality of superimposed webs withdrawn from a corresponding number of supply rolls, into sheets of a defined length. In most instances, the discharge conveyor is formed by pairs of conveyor belts between which the formed layers of sheets are drawn by means of the clamping device. During the transfer of the layers to the conveyor belt pairs, the clamping device is supposed to at least approximately reach the speed of the conveyor belts. For this reason, the mechanical transmission which drives the clamping device and the abutment is kinematically connected to the discharge conveyor in such a manner as to operate in synchronism therewith. An arrangement of this type is shown, for instance, in the German published patent application DE-OS No. 2,508,745.

The cooperation of the abutment and the clamping device, as well as the operating speeds thereof, depend on the speed of advancement of the supplied sheets and hence on the machine speed and the number of the sheets which are collected in a given layer. The proportion of the machine cycle to the operating cycle of the arrangement determines the number of the sheets collected in a particular layer.

The conventional arrangements of this type are connected to the main drive of the machine by means of exchangeable wheels, so that the number of the sheets which are collected in a particular layer and which are transported in such layer by means of the clamping device, can be changed by utilizing different exchangeable wheels. Usually such wheels include meshing gears or the like. When this expedient is resorted to, it must be remembered that the jaws of the clamping device must close with a speed which is dependent on the spacing of the sheets relative to one another or on the extent of the so-called overlap and the advancing speed of the sheets. This is so inasmuch as the clamping device must grip the collected layer before the following sheet reaches its operating range. In the conventional arrangements, this is taken care of in that a control segment of a cam which controls the closing of the jaws of the clamping device is exchanged at the time that the exchangeable wheels are exchanged.

It will become apparent from the above discussion that the conversion of the arrangement is a very time-consuming task. In addition thereto, in order to be able to adapt the performance of the arrangement to the performance conditions or demands, it is necessary to obtain and store a multitude of exchangeable wheels or gears and corresponding control cam segments.

The impossibility of rapid conversion of the arrangement is particularly disadvantageous when a plurality of paper webs are superimposed in the machine upon one another and cut simultaneously so that, during a single machine cycle, for instance, five sheets are supplied through the collecting location at any time. Now, when it is desired to form layers containing 20 sheets, the clamping device must perform an operating cycle after each four machine cycles. Should one of the paper webs tear, or should it be established that one of the sheets is of inferior quality, the machine could continue its operation with the remaining four webs if it were possible to immediately adjust the arrangement with the clamping device in such a manner that it would perform an operating cycle at each five machine cycles. However, in view of the fact that, as explained above, this changeover or adjustment is very time consuming, one can just as well change the respective supply roll in approximately the same time as it would take to modify the transmission. Thus, whether changing the gears or other wheels of the transmission and the corresponding segments, or exchanging the defective supply roll or correcting the defect of the same, an extensive interruption of production is unavoidable.

There are also known arrangements in which the ratio of the operating cycle of the arrangement to the machine cycle can be changed without interruption of production by a simple adjustment of a counter. However, arrangements of this type are limited as to their output. In particular, they are not suited for handling sensitive papers, such as carbon papers. These arrangements include separate pneumatic drives for the individual function elements, such drives being controlled by a counter and a step-by-step control which is driven in the machine cycle. The use of the pneumatic drives is the reason for the limitation of the output of the arrangement, as well as for the abrupt clamping operation of the jaws of the clamping device which, as explained above, is detrimental to certain types of paper. On the other hand, such sensitive paper types can be handled by the device of the initially discussed kind.

OBJECTS AND SUMMARY OF THE INVENTION

It is an object of the invention to develop a paper sheet layer forming and transporting arrangement which does not exhibit the disadvantages of the prior-art arrangement of this type.

Another object of the invention is to provide an arrangement which can be easily and rapidly converted from counting one number of sheets or sheet groups per layer to a different number.

A concomitant object of the invention is to provide an arrangement which is simple, easy to install and operate, and reliable.

One feature of the present invention resides in the provision of an arrangement for forming successive layers of sheets of paper and the like from a stream of individual sheets supplied in succession to a collecting location by a supply conveyor and for transferring the formed layers to a continuously advancing discharge conveyor which, comprises abutment means arranged at the collecting location and movable between a first position in which it extends into, and a second position in which it is spaced from, the stream of the sheets; clamping means including jaws movable together and apart and mounted for movement between the collecting location and the discharge conveyor; and means for moving the abutment and the clamping means in coordination with one another including a mechanical transmission interposed between the abutment means and the clamping means, a prime mover kinematically separated from the supply and discharge conveyors and operating the mechanical transmission, and means for controlling the speed of operation of the prime mover. Advantageously, the controlling means includes means for effecting acceleration including adjustable counting means, means for effecting deceleration including a first sensor operative to sense a certain position of the clamping means, means for effecting stoppage including a second sensor operative for sensing a predetermined initial position of the clamping means, and means for limiting the speed of rotation including a signal generator operative to sense the advancement speed of at least one of the conveyors.

When the arrangement is constructed in the above-indicated manner, that is with an independent drive for the clamping means and the abutment means, it renders it possible to arbitrarily choose the ratio of the machine cycles (number of sheets) to the operating cycle of the arrangement (corresponding to one layer), wherein this selection or choice can be accomplished by a simple actuation of a switch or the like. The required coordination of the movements of the abutment means and of the clamping means is assured, despite the use of an independent drive, by the aforementioned mechanical transmission. The controlling means which form a part of the invention assure that the operating cycle of the arrangement invariably starts from the same basic position, which renders the use of the separate drive for an arrangement here under consideration possible in the first place. This condition cannot be satisfied by a different solution which would obviously come to mind, namely, to connect the arrangement, via a controllable coupling, with the main drive of the machine.

For the unproblematical cooperation of the arrangement with the discharge conveyor and the machine arranged upstream of the same, the driving motor constituting the prime mover must be exactly controllable as to its speed of rotation. For this reason, in accordance with a further feature of the present invention, a speed-controllable direct current motor is used as the driving motor. The control of the operating cycle of the arrangement is achieved with the desired accuracy in such a manner that the machanical transmission is provided with a timing shaft which performs one revolution during each operating cycle of the arrangement. Then, the above-mentioned sensors are associated with this timing shaft, and means for actuating the sensors is mounted on the timing shaft.

When the machine operates at a certain speed, that is, when the individual sheets are supplied against the abutment means in a certain cyclic succession, the clamping means must be brought with a corresponding acceleration into the receiving position and grip the layer at the right time within the cycle. This is necessary in order for the jaws of the clamping means to grip the collected layer before the arrival of the next succeeding sheet, on the one hand, but to grip the layer only after the last sheet of the layer has reached the abutment means, on the other hand. In order for these conditions to be met at all machine speeds, that is, for the arrangement to also properly operate during the initial acceleration and the terminal deceleration of the machine, it is proposed, according to a particularly advantageous embodiment of the invention, that the signal generator capable of sensing the advancement speed of the supply conveyor and/or the discharge coveyor be additionally connected to the controlling means which is constructed as a speed and acceleration regulating arrangement by means of a squaring member, which renders it possible to maintain the lengths of the acceleration and deceleration paths of the clamping means constant. This means that the instantaneously achieved speed raised to the second power is used as the controlling value for the acceleration, which entails that the length of the path for the acceleration is independent of the speed to be achieved.

When the discharge conveyor consists of pairs of conveyor belts between which the layers are introduced by means of the clamping means, the movement of the clamping means must be coordinated, at least approximately, to the working cycle of the machine which is arranged upstream as well as to the advancing speed of the discharge conveyor. For all practical purposes, this is only possible when the discharge conveyor is kinematically connected with the main drive of the machine. Under these circumstances, the signal generator need not directly sense the speed of advancement of the supply conveyor and/or the discharge conveyor; rather, it can be associated with a timing shaft of the machine. On the other hand, when the clamping means merely deposits the layers on simple conveyor belts, it is not absolutely necessary that synchronism exist during the transfer. In this event, the discharge conveyor can be powered, for instance, by a machine arranged downstream of it, or can be provided with its own drive, and the signal generator senses only the speed of the supply conveyor. Naturally, it can sometimes also be necessary to make the control of the arrangement dependent on the operation of the machine arranged downstream of the arrangement, in which case the signal generator must sense the speed of advancement of the discharging conveyor, when transfer in synchronism is required at this region.

As already mentioned before, the jaws of the clamping device must close at a speed which is dependent on the advancing speed of the supply conveyor or of the supplied sheets. This is assured, according to a further aspect of the present invention, in that in its initial position the clamping means is spaced, by a corresponding arrangement of the second sensor, from the collecting location by a distance which at least corresponds to the length of the acceleration path. This means that the drive reaches the desired speed which is correlated to that of the supply conveyor when the clamping means reaches the collecting location. As initially mentioned, the conventional devices operate exactly in the machine cycle, that is, they do not "count" any sheets; rather, they "count" the number of cuts of the transverse cutter. As a rule, a sheet-separating station is arranged in the machine upstream of the collecting location. This sheet-separating station eliminates sheets of inferior quality from the sheet stream. Of course, in the conventional machines, such eliminated sheets are missing in the collected layers. Now, the segregation of the drive of the layer forming and transferring arrangement of the present invention from the main drive of the machine, and the construction of the drive of the arrangement in accordance with the invention, render it possible to perform exact counting of all sheets which are actually forwarded to the collecting location, and to form layers having the desired number of sheets therein, in that the counter which forms a part of the counting means is connected with a sensing device that is arranged and operated for sensing the supply of the individual sheets to the collecting location.

The speed at which the individual sheets are forwarded toward the collecting location, and the distance between the sensing device and the abutment means of the collecting location determine the timing of the issuance of a starting signal for the acceleration of the drive of the arrangement. In order or achieve that the position of the sensing means for sensing the supply of the sheets relative to the abutment means need not be changed when the degree of overlap of the sheets is changed, it is provided, according to a further aspect of the invention, that the squaring member be additionally provided with a manually adjustable signal generator.

A certain position of the clamping and abutment means must be correlated to each displacement angle of the drive. This is achieved, in accordance with the invention, in that there is used a per se known transmission which includes control cams connected to the timing shaft as well as kinematic linkages actuated by the cams and connected with the abutment and clamping means.

The novel features which are considered as characteristic of the invention are set forth in particular in the appended claims. The improved paper sheet layer forming and transferring arrangement itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
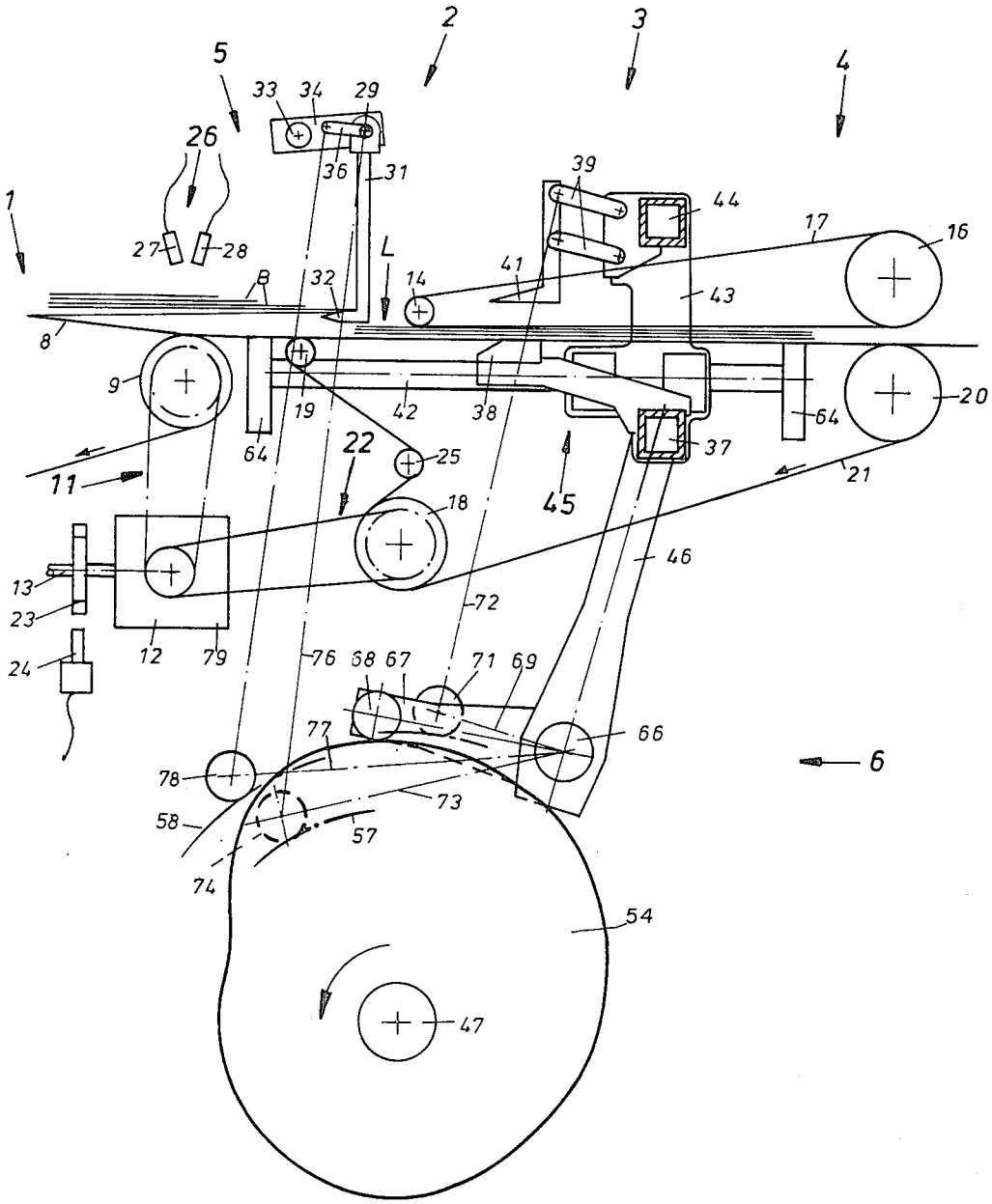
FIG. 1 is a somewhat diagrammatic side elevational view of the arrangement of the present invention as used in a counting and collecting station.
Figure 2:
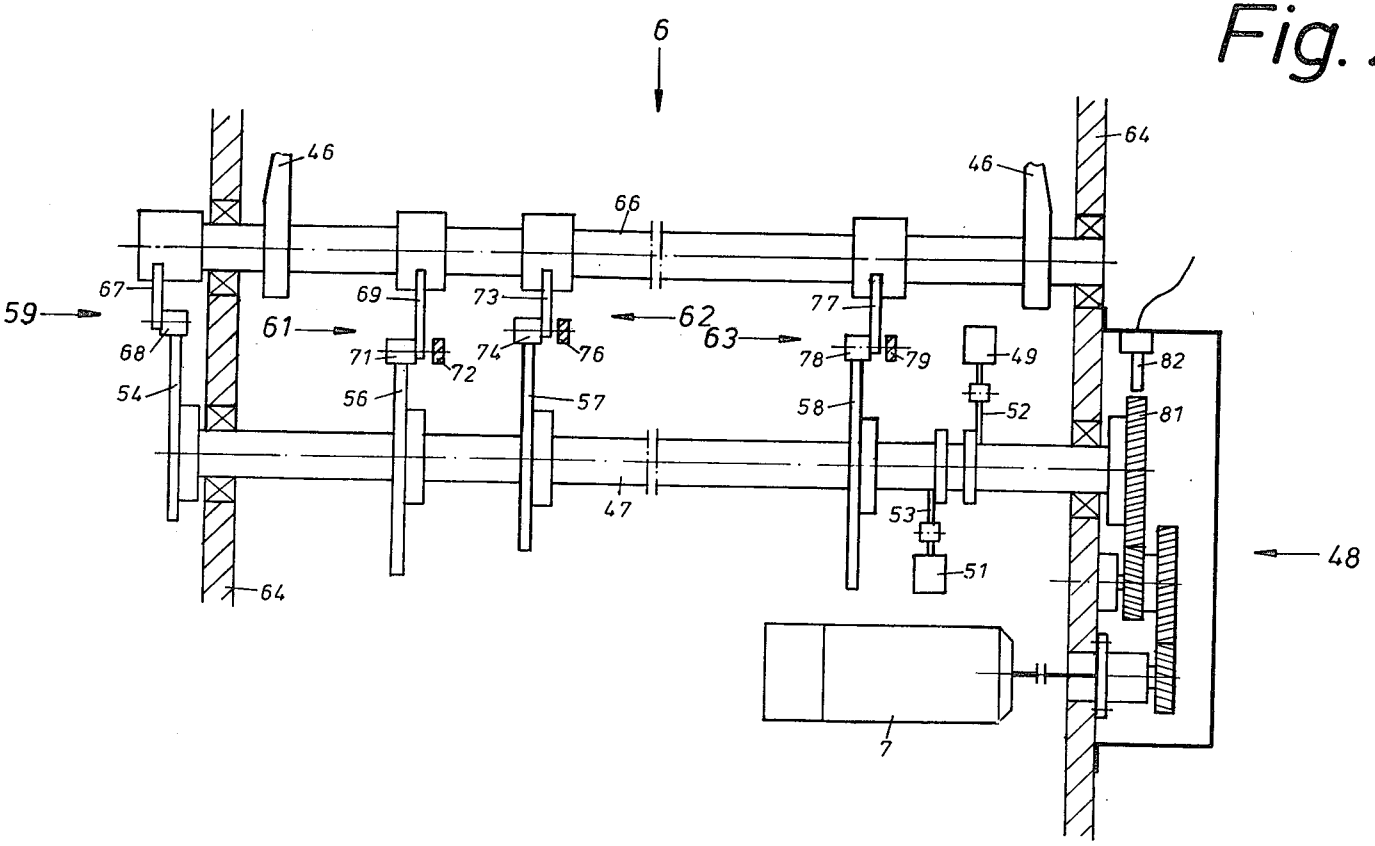
FIG. 2 is a top plan view of a transmission for the arrangement of FIG. 1.

Referring first to FIG. 1, the reference numerals 1 to 7 indicate essential components of, or cooperating with, the arrangement of the present invention, namely, a supply conveyor 1, a controllable abutment 2 of a collecting station 5, a controllable and reciprocable clamping device 3, a discharge conveyor 4, and a transmission 6 which is connected to a prime mover or driving motor 7 (FIG. 2) which is associated only with this transmission 6.

The supply conveyor 1 includes a plurality of adjacently arranged conveyor belts 8 which are trained about a roller 9. The roller 9 is connected, by a toothed belt drive 11, with a transmission 12 which receives motion via shaft 13 from a main drive (not shown) of the machine arranged upstream of the arrangement of the present invention. The exact construction of the supply conveyor 1 in the region of the collecting station 5 may be seen in the German published patent application DE-OS No. 2,508,745.

The discharge conveyor 4 consists of a plurality of adjacently arranged conveyor belt pairs. Each conveyor belt pair includes an upper belt 17 which is trained about rollers 14 and 16, and a lower belt 21 which is trained about rollers 18, 19 and 20 as well as about a tensioning roller 25. The rollers 14 and 18 are kinematically connected to one another, in a conventional manner which has not been illustrated, so that the conveyor belts 17 and 24 advance in synchronism. The roller 18 is connected with the transmission 12 via toothed belt drive 22.

A toothed disc 23 is mounted on the shaft 13 of the transmission 12. A signal generator 24 which is constructed as a proximity detector capable of sensing the speed of advancement of the supply conveyor 1.

A sensing device constructed as a reflection-light device 26 is arranged upwardly of the supply conveyor 1. It is capable of sensing the supply of sheets B to the collecting station 5. The device 26 includes a light source 27 and a receiver 28 which are so arranged that the axes thereof form the letter V. As a result of this arrangement the light emitted by the source 27 reaches the adjacent sheet B at an angle so that a shadow is formed next to the respective leading edge of the respective sheet B. The highly sensitive receiver 28 senses the presence of this shadow. Both the light source 27 and the receiver 28 are of conventional design.

The abutment 2 is formed by a row of levers 31 which are rigidly connected to a shaft 29 next to one another. Each of the levers 31 includes a support 32 for the sheets B, which encloses an angle with the remainder of the lever 31. The shaft 29 is supported, at each of its ends, on a lever 34 which is pivotable about an axle 33. Furthermore, another lever 36 is connected to the shaft 29, this lever 36 cooperating with the transmission 6 which will be discussed in more detail later.

The clamping device 3 includes a jaw 38 which is rigidly connected to a crossbeam 37, and a jaw 41 which is mounted for upward and downward movement on parallel links 39. At the two sides of the discharge conveyor 4, there are provided carriers 43 which are supported on guiding rods 42 and which are connected with one another by the above-mentioned crossbeam 37 and a further crossbeam 44. The carriers 43 and the crossbeams 37 and 44 together form a clamping carriage 45. A pair of the above-mentioned parallel links 39 is mounted on each of the carriers 43. One lever 46 of the transmission 6 is articulately connected to each of the carriers 43.

The transmission 6 includes a so-called timing shaft 47 which is connected to the prime mover 7 that is constructed as a direct current electric motor, via a reduction gear transmission 48. Means for actuating a first sensor 49 which is constructed as a switch, and of a second sensor 51 which is also constructed as a switch, are connected to the timing shaft 47. Such means include adjustable control cam segments 52 and 53. Furthermore, the timing shaft 47 has four control cams 54, 56, 57 and 58 connected thereto, which cams actuate kinematic linkages 59, 61, 62 and 63, respectively. The reference numerals 64 denote in FIG. 2 a machine frame which supports the timing shaft 47. Furthermore, the machine frame 64 also supports a further shaft 66, and the gear transmission 48 as well as the previously discussed guiding rods 42 are also affixed thereto.

The kinematic linkage 59 consists of the levers 46 for moving the clamping carriage 45 to and fro, the levers 46 being connected to the shaft 66 for joint angular displacement therewith. The linkage 59 further includes a lever 67 which is affixed to the shaft 66 and on which there is rotatably mounted a roller 68 which tracks the control cam 54.

The kinematic linkage 61 includes a lever 69 which is tiltably supported on the shaft 66. A roller 71 which tracks the control cam 56 is mounted on this lever 69. A lever 72 is also connected to the lever 69 coaxially with the roller 71 and is articulately connected to the jaw 41 of the clamping device 3. The linkage 61 thus controls the opening and closing of the clamping device 3.

The kinematic linkage 62 controls the lowering of the abutment 2 and includes a lever 73 which is tiltably mounted on the shaft 66. A roller 74 which tracks the control cam 57 is mounted on the lever 73. A lever 76 is mounted on the lever 73 for pivoting coaxially to the roller 74 and is pivotally supported on the shaft 29 of the clamping device 3.

The kinematic linkage 63 controls the tilting of the abutment 2 and includes a lever 77 which is tiltably supported on the shaft 66 and supports a roller 78 which contacts the control cam 58. A lever 79 which is articulately connected to the lever 36 of the clamping device 3 is connected to the lever 77 coaxially to the roller 78.

For the sake of clarity, only the control cam 54 is fully shown in FIG. 1. The exact configuration of all of the control cams can be ascertained from the displacement diagrams of FIG. *3a* in which the up and down movement of the abutment 2 is indicated by the line *2a*, the tilting movement of the abutment 2 by the line *2b*, the opening and closing of the clamping device 3 by the line *3a* and the movement of the clamping carriage 45 by the line *45a*, per revolution of the timing shaft 47.

An actual value generator constructed as a proximity detector 82 capable of detecting the speed of rotation of the timing shaft 47 or of the driving motor 7 is associated with a gear 81 forming part of the gear transmission 48 and mounted on the shaft 47.

Figure 3A:
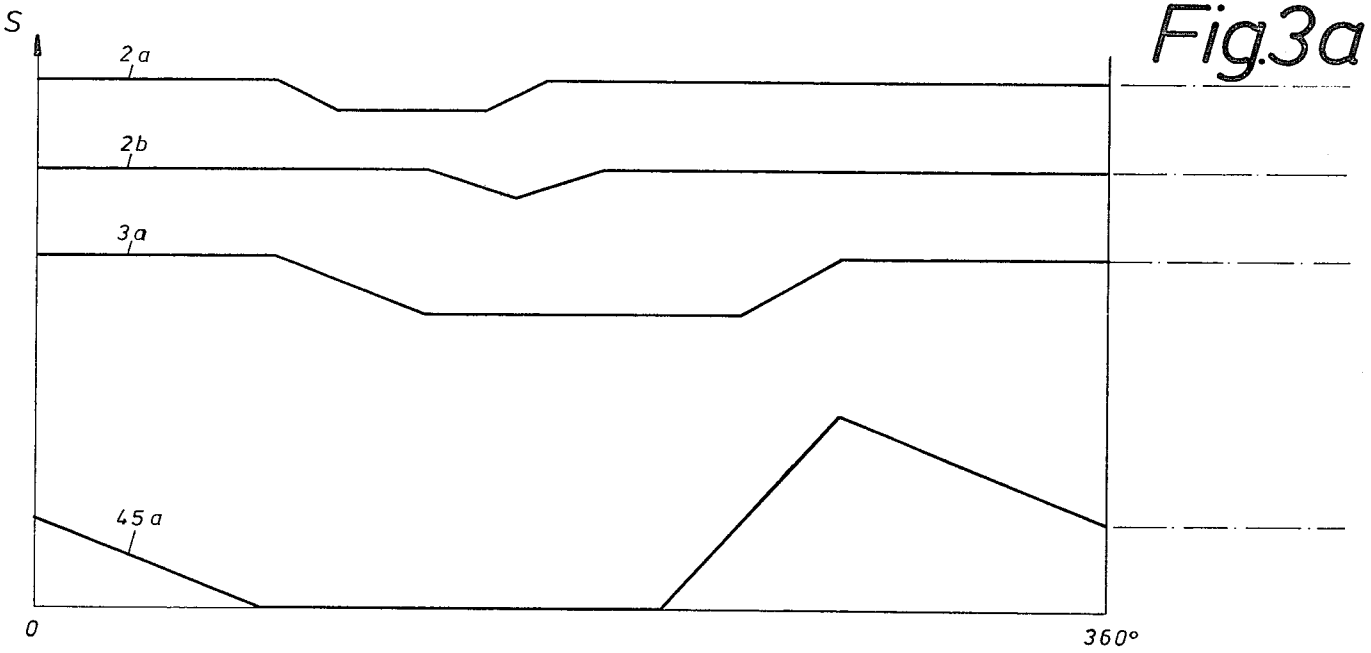
FIG. 3*a* is a diagram depicting movements of the individual elements of the arrangement of FIG. 1.

In FIG. 3 the line *47a* indicates the variation of the speed of rotation of the timing shaft 47 or of the driving motor 7 per revolution of the timing shaft 47.

Figure 4:
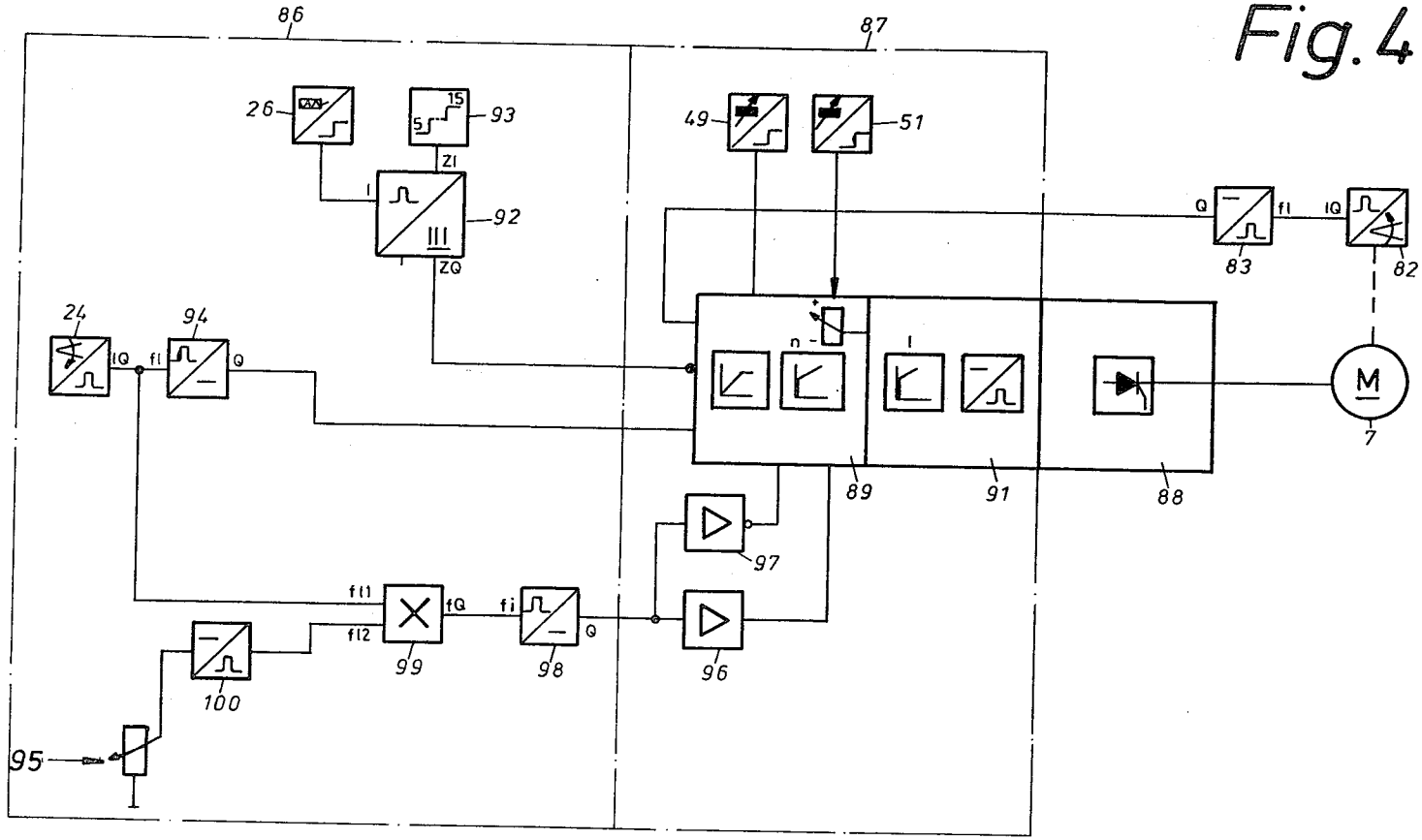
FIG. 4 is a diagrammatic view of the control circuitry for the drive of the arrangement of FIG. 1.

FIG. 4 shows a control circuitry for controlling the operation of the arrangement of the present invention. It can be subdivided into a function generator 86, a logic unit 87, and a power part, more particularly a customary power amplifier 88. The function generator 86 and the logic unit 87 together form a control means for controlling the speed of rotation of the driving motor 7. This control means is constructed as an acceleration and a rotational speed regulating arrangement. Two integrated circuit boards 89 and 91 manufactured by the firm Siemens of Erlangen, Federal Republic Germany and designated as "A4.00" and "A6.00", form the core of the logic unit 87. Basically, the integrated circuit 89 includes an integrator, a speed of rotation regulator, as well as an actual and limiting value indicator, while the integrated circuit 91 includes the overload and actual value supervision of the regulating operation.

To the integrated circuit 89 there are connected a counter 92 which is adjustable by means of a pre-selecting switch 93 and to which there is connected the light detecting device 26, the two sensors 49 and 51, via a frequency-voltage converter 94 the signal generator 24 which is further connected with the integrated circuit 89 via two amplifiers 96 and 97 (of which the latter is constructed as an inverting amplifier) via a frequency-voltage converter 98 and a squaring member 99, and the proximity detector 82 via a frequency-voltage converter 83. The squaring member 99 raises the value of the signal reaching the same to the second power. A manually adjustable signal generator constructed as a potentiometer 95 is connected to the squaring member 99 via a voltage-frequency converter 100.

The discussion of the operation will proceed from the position assumed by the arrangement in FIG. 1, that is, when the arrangement assumes its idle or ready position between two cycles of operation. The sheets B are supplied by the supply conveyor 1 and advanced until their leading edges reach the levers 31 of the abutment 2. In this manner, a certain number of the sheets B is collected at the collecting station 5 to form a layer L. The support means 32 provided on the levers 31 maintain the leading edges of the sheets B at a distance from the conveyor belts 21, so that a previously collected layer L can be conveyed from below the layer which is then being collected.

Based on the signals issued by the reflection light device 26, the counter 92 counts the number of the actually supplied sheets B and transmits a signal to the integrated circuit 89 when the number selected by the pre-selecting switch 93 is achieved. The output signal of the counter 92 triggers a cycle of operation of the arrangement. During this cycle, the driving motor 7 first accelerates the transmission 6 to the desired speed which is determined by the signal generator 24. It is assured, due to the raising to the second power of the signal representative of the desired speed to be achieved, by means of the squaring member 99, that the driving motor 7 and the transmission 6 reach their desired speeds when the clamping carriage 45 reaches the transfer position illustrated in FIG. *5a*. While the clamping carriage 45 remains in this position, the abutment 2 as well as the jaw 41 of the clamping device 3 are lowered at a speed which is accurately coordinated to the supply speed of the sheets B and their spacing relative to one another. Thus, the clamping device 3 grips the collected layer L only when the sheet B which, via the signal of the reflection light device 26, triggered the output signal of the counter 92, has reached the abutment 2, on the one hand, and the clamping device 3 grips the layer L timely at such an instant that the following sheet B which no longer belongs to this layer L runs onto the correspondingly formed jaw 41. The exact instant of gripping of a layer L by the clamping device 3 can be coordinated in an optimum fashion to the degree of overlap of the supplied sheets B by means of the potentiometer 95 which is also connected to the squaring member 99.

Figure 5A:
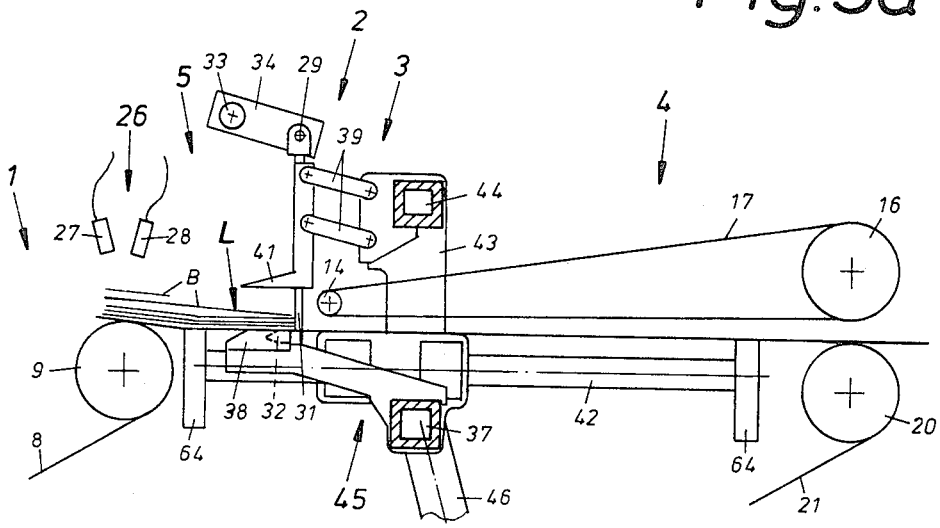
FIGS. 5*a* to 5*c* are side elevational views of the elements of the arrangement of the present invention in certain characteristic positions which they assume during the operating cycle of the arrangement.
Figure 5B:
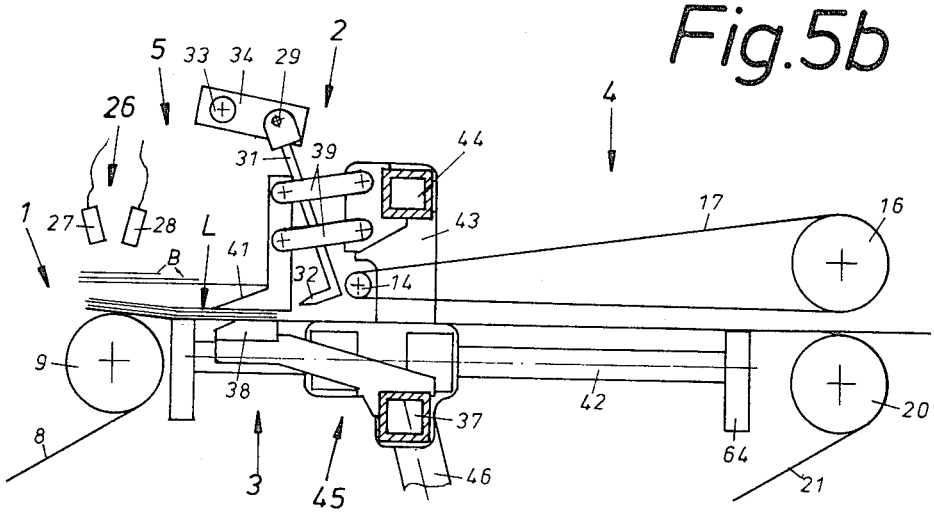
Figure 5C:
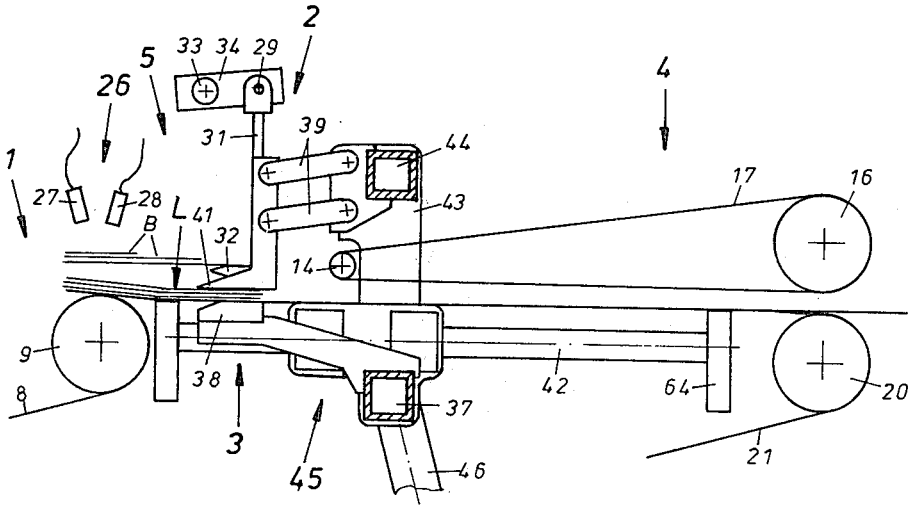

Now, the jaw 41 of the clamping device 3 takes over for a short period of time the function of the abutment 2, inasmuch as the levers 31 of the latter are tilted in the advancement direction of the sheets B as shown in FIG. 5*b*. Subsequently, the levers 31 are lifted and tilted back so that the supporting means 32, as shown in FIG. 5*c*, take over the sheets B which have accumulated at the jaw 41 in the meantime. Then, the clamping carriage 45 is moved to its other terminal position and back into the position illustrated in FIG. 1. During the movement to the other end position, the jaw 41 is moved upwardly, which means that the clamping device 3 is opened when the speed of displacement of the clamping device 3 and the speed of advancement of the discharge conveyor 4 are at least approximately equal. As a result of this, the layer L will be transferred to the conveyor belts 17 and 21 of the discharge conveyor 4, engaged by the latter in a gentle manner and conveyed away from the collecting station 5. The arrangement of the present invention exactly reaches the desired initial position after each cycle of operation. This is due to the fact that, shortly after the clamping carriage 45 has reached the right hand terminal position thereof, a signal is transmitted by the sensor 49 to the integrated circuit 89, with the result that, subsequently, via the inverting amplifier 97, the signal of the squaring member 99 becomes effective with a negative sign and causes the deceleration of the driving motor 7 along a constant path to a very low speed of rotation (crawling speed). The deceleration of the driving motor 7 is augmented by the action of the clamping carriage 45 which, after reaching its right-hand terminal position, has to be accelerated again for movement toward the left-hand terminal position thereof. When the sensor 51 transmits a signal, the driving motor 7 can be brought to an immediate stop in view of the fact that it runs at a very low speed at such time.

Figure 3B:
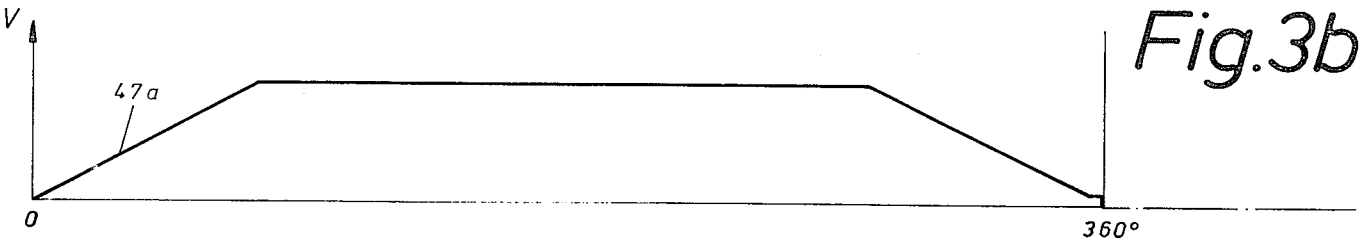
FIG. 3*b* is a diagram of a speed of the drive of the arrangement of FIG. 1.

Inasmuch as the lengths of the paths of displacement of the clamping carriage 45, or the angles of rotation of the driving motor 7 or of the timing shaft 47 are predetermined for the acceleration and for the deceleration, only the slopes or inclinations of the flanks of the curve 47*a* in FIG. 3*b* change in dependence on the speed of advancement of the supply conveyor 1 and the discharge conveyor 4. Inasmuch as, on the other hand, the closing and opening of the clamping device 3, the tilting of the abutment 2, and the movement of the clamping carriage 45 from the left-hand to the right-hand end position occurs during the period of time when the driving motor 7 or the timing shaft 47 rotates at the respective desired speed which is coordinated with the speeds of advancement of the supply conveyor 1 and the discharge conveyor 4, each operating cycle of the arrangement is exactly coordinated with the operating cycle of the machine which is arranged upstream of the arrangement of the present invention; however, the numerical ratio of the operating cycle of the arrangement to the operating cycles of the upstream-arranged machine can be freely selected.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

What is claimed is:

1. An arrangement for forming successive layers of sheets of paper and the like from a stream of individual sheets supplied in succession to a collecting location by a supply conveyor, and for transferring the formed layers to a continuously advancing discharge conveyor, comprising abutment means arranged at the collecting location and movable between a first position in which it extends into, and a second position in which it is spaced from, the stream of the sheets; clamping means including jaws movable together and apart and mounted for movement between the collecting location and the discharge conveyor; and means for moving said abutment means and said clamping means in coordination with one another, including a mechanical transmission interposed between said abutment means and said clamping means, an electric motor kinematically separated from the supply and discharge conveyors and operating said mechanical transmission, and means for controlling the speed of operation of said motor, said controlling means comprising means for effecting acceleration including adjustable counting means, means for effecting deceleration including a first sensor operative to sense a certain position of said clamping means, means for effecting stoppage including a second sensor operative to sense a predetermined initial position of said clamping means, and means for limiting the rotational speed including a signal generator operative to sense the speed of advancement of at least one of said conveyors.

2. The arrangement as defined in claim 1, wherein said electric motor is a controllable direct current motor.

3. The arrangement as defined in claim 1, wherein said controlling means further includes means for regulating acceleration and decelaration, and means for maintaining the lengths of the acceleration and deceleration paths of said clamping means constant, including a squaring member interposed between said signal generator and said regulating means.

4. The arrangement as defined in claim 3, wherein said second sensor which determines said initial position of said clamping means is so situated that the clamping means is spaced by at least the length of said acceleration path from the collecting location in said initial position thereof.

5. The arrangement as defined in claim 3, wherein said controlling means further includes a manually adjustable signal generator connected to said squaring member.

6. The arrangement as defined in claim 1, wherein said mechanical transmission includes a timing shaft which completes one revolution per cycle of operation of the arrangement and said controlling means further includes means for acutating said sensors, said actuating means being mounted on said timing shaft for rotation therewith.

7. The arrangement as defined in claim 6, wherein said mechanical transmission further includes control cams connected to said timing shaft and kinematic linkages actuated by said control cams and connected to said abutment means and said clamping means.

8. The arrangement as defined in claim 1, wherein said counting means includes an adjustable counter and a sensing device arranged and operative to sense the delivery of the individual sheets to the collecting location.

* * * * *